US007971461B2

(12) United States Patent
Denker

(10) Patent No.: US 7,971,461 B2
(45) Date of Patent: Jul. 5, 2011

(54) METHOD OF AND APPARATUS FOR MANUFACTURING A METAL STRIP

(75) Inventor: Wolfgang Denker, Freudenberg (DE)

(73) Assignee: SMS Demag AG, Duesseldorf (DE)

( * ) Notice: Subject to any disclaimer, the term of this patent is extended or adjusted under 35 U.S.C. 154(b) by 799 days.

(21) Appl. No.: 11/886,056

(22) PCT Filed: May 19, 2006

(86) PCT No.: PCT/EP2006/304753
§ 371 (c)(1),
(2), (4) Date: Sep. 6, 2007

(87) PCT Pub. No.: WO2006/122817
PCT Pub. Date: Nov. 23, 2006

(65) Prior Publication Data

US 2008/0125298 A1 May 29, 2008

(30) Foreign Application Priority Data

May 20, 2005 (DE) ..... 10 2005 023 270

(51) Int. Cl.
*B21C 51/00* (2006.01)
*B21B 37/00* (2006.01)

(52) U.S. Cl. ..... 72/37; 72/11.1

(58) Field of Classification Search ..... 72/8.3, 72/8.4, 8.6, 8.7, 11.1, 11.2, 11.4, 12.3, 37
See application file for complete search history.

(56) References Cited

U.S. PATENT DOCUMENTS

| | | | | |
|---|---|---|---|---|
| 5,964,114 | A | 10/1999 | Noe et al. | |
| 5,996,384 | A * | 12/1999 | Steeper et al. | 72/37 |
| 6,232,617 | B1 | 5/2001 | Vanhee | |
| 6,286,349 | B1 * | 9/2001 | Muller et al. | 72/37 |
| 6,289,750 | B1 * | 9/2001 | Baumann et al. | 73/862.583 |
| 6,349,581 | B1 * | 2/2002 | Palzer et al. | 72/11.4 |
| 2005/0157302 | A1 | 7/2005 | Krambeer | |

FOREIGN PATENT DOCUMENTS

| | | |
|---|---|---|
| DE | 199 19 801 A1 | 11/2000 |
| DE | 103 01 379 A1 | 7/2004 |
| FR | 27 25 512 A1 | 4/1996 |
| JP | 2000-171411 | 6/2000 |
| JP | 2002-139447 | 5/2002 |
| JP | 2003-057189 | 2/2003 |
| RU | 2048938 | 11/1995 |
| RU | 2203752 | 5/2003 |

* cited by examiner

*Primary Examiner* — Teresa Ekiert
(74) *Attorney, Agent, or Firm* — Abelman, Frayne & Schwab

(57) ABSTRACT

The invention relates to a method for manufacturing a metal strip (1), in which the metal strip (1) is guided over a number of rolls (2, 3, 4, 5) under such a strip stress (S), and is moved in a conveying direction (F), that it is largely flat at least between two rolls (2, 3). In order for it to be possible to inspect the strip in a simple and space-saving way, the invention provides for the inner tensile stresses which act in the metal strip (1) which is largely flat under tensile stress between the at least two rolls (2, 3), to be made optically visible and for the tensile stresses or tensile stress differences which are determined in this way to be utilized during the manufacture of the metal strip (1). Furthermore, the invention relates to an apparatus for manufacturing a metal strip.

4 Claims, 1 Drawing Sheet

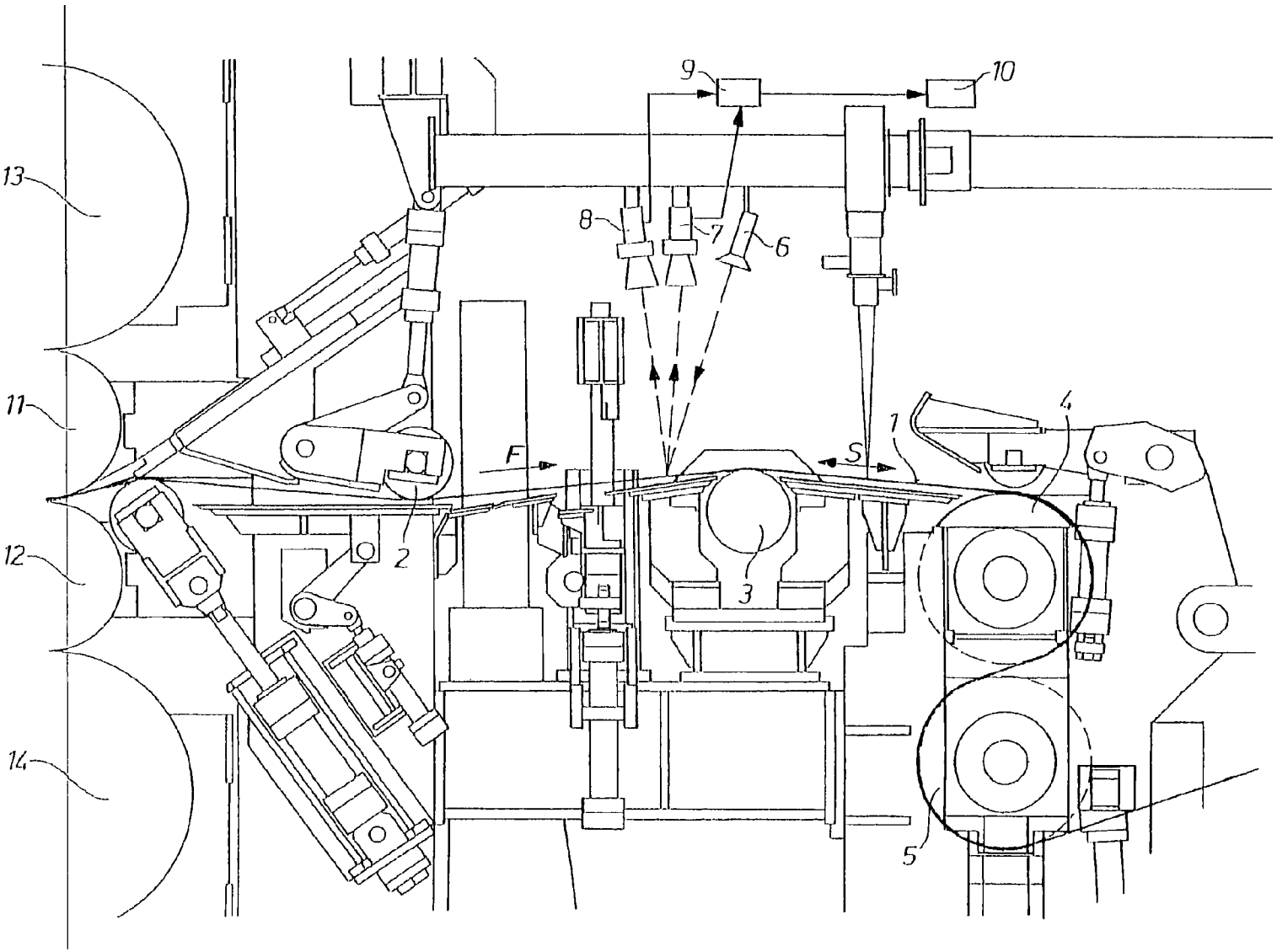
10
9
6
7
8
4
1
S
3
F
2
5
13
11
12
14

METHOD OF AND APPARATUS FOR MANUFACTURING A METAL STRIP

BACKGROUND OF THE INVENTION

1. Field of the Invention

The invention relates to a method of manufacturing a metal strip in which the metal strip is guided over a number of rolls under such strip tension and is advanced in a transporting direction so that it is flat to a large extent at least between two rolls. The invention further relates to an apparatus for manufacturing a metal strip.

2. Description of the Prior Art

During rolling and skinpass rolling of a metal strip, the flatness, together with the thickness and cleanliness of the strip, is a decisive factor. Therefore, it is necessary to undertake inspection during manufacturing of a metal strip to insure quality of the production, wherein, if necessary, based on the results produced by inspection, the manufacturing process should be modified.

To the end, in conclusion of a rolling process, often, the metal strip is subjected to the flatness measurement, wherein unevenesses of the strip should be revealed. To this end, flatness measuring rollers are used which are pressed with a predetermined prestress against a metal strip that is guided under tension. By measuring the imprints of the flatness measuring roller resulting from the unevenesses of the metal strip, a conclusion can be made about the unevenesses in the metal strip. Also known are systems that visualize differences in tension caused by its variations.

Unevenesses in a metal strip can be determined not only with contacting rollers but also in contactless manner. To this end, e.g., the JP 2000046752 A discloses an optical system that has an illuminating device for the strip and cameras. Therefore, it is possible to three-dimensionally measure the surface of a metal strip and determined the measurement result.

Flatness of a metal strip can also be measured with an apparatus such as disclosed in EP 1 418 400 A2. Here, likewise, deviations are determined with a camera (CCD-Kamera: Charge-Coupled-device camera).

Similar systems are disclosed in DE 197 58 466 A1 and DE 199 32 324 A1.

In all of the above-mentioned cases, unevenesses of the strip surface are measured and, if necessary, change of process parameters is undertaken.

It has been determined that specific measurement results under a corresponding strip tension are difficult to interpret because, dependent on the strip tension that is applied to the metal strip, flatness changes. Therefore, based on the strip tension to which a rolling stock is subjected in a rolling process, the stress differences over the strip width in form of buckling or unevenesses cannot be recognized or are recognizable with much difficulty.

It is particularly desirable to be able to visualize the stress distribution over the width of the metal strip in order to make a conclusion about the strip quality. At that, the apparatus for this determination should be formed in a space-saving manner and should not require any large expenses for its installation and operation.

SUMMARY OF THE INVENTION

Accordingly, the object of the invention is a method and an associated apparatus of the type discussed above modified so that it is possible to obtain information even under a high strip tension which would enable to control the manufacturing process in such a way that the strip quality is optimized.

This object is achieved according to the invention by a method according to which in the metal strip, which is flat to a large extent under tension between the at least two rolls, inner tensile stresses are made optically visible, and the generated tensile stresses or tensile stress differences are used during manufacturing of the metal strip.

According to an improvement, a strip tension applied to the metal strip is selected dependent of the tensile stresses generated in the metal strip. Advantageously, it is contemplated that with an increased tensile stress in the metal strip, the strip tension, which is applied to the metal strip is also increased.

By the input of the associate high or low individual tension into the control circuit, the flatness can be influenced.

Advantageously, the metal strip is illuminated with a light source and is photographed with two cameras from two different directions.

Tensile stresses, which act in the metal strip, which can be determined by the above-mentioned process, advantageously, are determined multiple times with short time intervals. The change of the tensile stresses, which act in the metal strip, can be ascertained by comparison of a number of tensile stresses determined in time intervals. With a plurality of pictures following one another within a short time, stress pictures for a rapidly moving strip are obtained.

The device for manufacturing a metal strip includes a number of rolls over which a metal strip is guided under a such strip tension and is advanced in a transporting direction so that it is flat to a large extent at least between two rolls.

According to the invention, it is provided that between two rollers, at least one light source for illuminating the metal strip is arranged, and in the region of the light source, at least one, preferably two, cameras is or are arranged and which take(s) pictures of the illuminated metal strip, and wherein the system consisting of a light source and camera or cameras is suitable for revealing tensile stresses acting in the metal strip.

Advantageously, two cameras are available which are arranged at a distance from one another so that the metal strip is photographed from two different directions. The cameras are preferably digital.

Further, receiving means, which stores the pictures taken by the camera or cameras in short time intervals, are available.

Finally, it is provided that the receiving means is connected with evaluation means suitable for comparison of pictures taken by the camera or cameras.

With the proposed process it is possible to guide the metal strip under a relatively high tension after rolling and thereby to a large extent flatly and, despite that, to be able to determine the unevenness of the strip, without taking into account high tensile stresses in the strip. The determined tensile stresses give a good indication of the quality of the finished strip so that, if necessary, the manufacturing parameters can be influenced.

BRIEF DESCRIPTION OF THE DRAWINGS

Further features and particularities of the invention follow from the claims and the description of an embodiment of the invention shown in the drawing. The single drawing shows a side view of a rolling apparatus for manufacturing metal strips.

DETAILED DESCRIPTION OF THE PREFERRED EMBODIMENT

A metal strip 1 is rolled in the left region of the FIGURE in a rolling region by working rolls 11 and 12 which are supported by two back-up rollers 13 and 14. Then, the metal strip 1 is advanced in a transporting direction F with a predetermined transporting speed, while being held at a certain strip tension S. The strip tension S is maintained by guiding the metal strip 1 linearly. It is guided, as it is particularly shown at the right side of the FIGURE, by two rollers 4 and 5 in a S-shaped manner, so that a desired level of the strip tension S can be maintained between rolls 11, 12 and rolls 4, 5.

Due to the strip tension S, the metal strip 1 has a high degree of flatness, i.e., the surface unevenness is small.

Between two rolls 2 and 3, the metal strip 1 is guided flatly to a large extent. There, a light source 6 is arranged that illuminates the surface of the metal strip 1. Further, two cameras 7 and 8 are provided at two different locations and an take two pictures of the strip surface.

The system that consists of the light source 6 and cameras 7 and 8 and that is suitable for the inventive method is known under Q-400 mark as digital 3D-Correlation System of the firm DANTEC Ettemeyer GmbH, Elchingen, Germany (www.dantec-ettemeyer.com) and can be obtained from the firm. The available system is suited very well for revealing inner tensile stresses in the, to a large extent flat, metal strip and for their evaluation even when strip tension variations in a small number are necessary.

The cameras 7 and 8 is connected with receiving means 9 that is capable of storing a number of pictures in a short time. The taken pictures can be evaluated by adjoining evaluation means 10, which permits to observe distribution of tensile stresses in the metal strip and their variation with time. Dependent thereon, the manufacturing process of the metal strip 1 can be regulated.

Advantageously, during the measurement of the stresses, the strip tension that corresponds to at least 10% of the limit of elasticity of the material of the metal strip, is maintained.

The use of the revealed tensile stresses or tensile stress differences in the metal strip 1 during the manufacturing of the metal strip 1 can consist in that the tensile stresses in the strip are observed and only when needed, i.e., when the stress distribution proportions in the strip exceeds an unallowable value, certain measures are undertaken.

However, a case can be contemplated when the generated values are input into a closed control circuit that directly controls the manufacturing process of the metal strip.

REFERENCE NUMERALS

1. Metal Strip
2. Roll
3. Roll
4. Roll
5. Roll
6 Light Source
7. Camera
8. Camera
9. Receiving Means
10. Evaluation Means
11. Working roll
12. Working roll
13. Back-up roll
14. Back-up roll
S Strip tension
F Transportation direction

The invention claimed is:

1. A method of manufacturing a metal strip which is guided over a number of rolls (2, 3, 4, 5) in a transporting direction under a strip tension that insures that the strip is flat to a large extent at least between two rolls (2, 3), comprising the step of providing a system for making inner tensile stresses in the movable metal strip (1) optically visible and having a light source (6) operable for illuminating an area of the strip (1) as it moves in the transporting direction, and two cameras (7, 8) located in a region of the light source (6) at a distance from each other and operable for photographing the area of the metal strip (1) illuminated by the light source from two different directions.

2. A method of manufacturing a metal strip which is guided over a number of rolls (2, 3, 4, 5) in a transporting direction under a strip tension that insures that the strip is flat to a large extent at least between two rolls (2, 3), comprising the steps of providing a system for making inner tensile stresses in the movable metal strip (1) optically visible and having a light source (6) for illuminating the strip (1) as it moves in the transporting direction, and two cameras (7, 8) in a region of the light source (6) at a distance from each other for photographing an area of the metal strip (1) illuminated by the light source from two different directions; and selecting a strip tension (S) applied to the metal strip (1) dependent on tensile stresses generated in the metal strip (1).

3. A method according to claim 2, wherein the tension selecting step includes increasing the strip tension (S) with an increase of the tensile stresses.

4. A method of manufacturing a metal strip which is guided over a number of rolls (2, 3, 4, 5) in a transporting direction under a strip tension that insures that the strip is flat to a large extent at least between two rolls (2, 3), comprising the steps of providing a system for making inner tensile stresses in the movable metal strip (1) optically visible and having a light source (6) for illuminating the strip (1) as it moves in the transporting direction, and two cameras (7, 8) in a region of the light source (6) at a distance from each other for photographing an area of the metal strip (1) illuminated by the light source from two different directions; and determining tensile stresses in the strip multiple times in short time intervals and determining a change of the tensile stresses in the strip by comparing a number of tensile stresses.

* * * * *

UNITED STATES PATENT AND TRADEMARK OFFICE

CERTIFICATE OF CORRECTION

PATENT NO. : 7,971,461 B2
APPLICATION NO. : 11/886056
DATED : July 5, 2011
INVENTOR(S) : Wolfgang Denker It is certified that error appears in the above-identified patent and that said Letters Patent is hereby corrected as shown below:

Title Page, Item (73) Assignee: should read --SMS Siemag AG, Duesseldorf (DE)--

Signed and Sealed this
Thirteenth Day of September, 2011

David J. Kappos

David J. Kappos
*Director of the United States Patent and Trademark Office*